US005630729A

United States Patent [19]

Francis

[11] Patent Number: 5,630,729

[45] Date of Patent: May 20, 1997

[54] W-2 BULB SOCKET ARRANGEMENT

[75] Inventor: Michael E. Francis, Warren, Ohio

[73] Assignee: General Motors Corporation, Detroit, Mich.

[21] Appl. No.: 578,416

[22] Filed: Dec. 26, 1995

[51] Int. Cl.[6] ..... H01R 13/73

[52] U.S. Cl. ..... 439/548; 439/699.2

[58] Field of Search ..... 439/548, 546, 439/547, 549, 699.2, 619, 602

[56] References Cited

U.S. PATENT DOCUMENTS

| | | | |
|---|---|---|---|
| 3,982,813 | 9/1976 | Cope et al. | 439/548 |
| 4,019,045 | 4/1977 | Bassett | 439/548 |
| 4,758,181 | 7/1988 | Reedy | 439/546 |
| 4,804,343 | 2/1989 | Reedy | 439/699.2 |
| 4,883,434 | 11/1989 | Toyoshima | 439/699.2 |
| 4,940,422 | 7/1990 | Forish et al. | 439/548 |

*Primary Examiner*—Gary F. Paumen
*Attorney, Agent, or Firm*—Ernest E. Helms

[57] ABSTRACT

A seal lamp socket arrangement for mounting a W-2 type bulb is provided including a housing with a collar opening and a base with a bore with opposed inwardly projecting tabs; a retainer cap with a diameter generally aligned with the housing bore with twist lock slots allowing for insertion through the housing opening past the housing opening opposed tabs and for connection with the housing upon rotation, the retainer having at least one internal ledge; a socket base with a flange for maintaining seal position, the socket base having a seal mounting portion to position a seal in sealing contact with the housing collar, the socket base also having at least two bores with an area reduction to entrap a spring terminal, and the socket base having two compliant tabs for capture of a W-2 type bulb and at least one ledge to connect the retainer whereby the retainer retains a seal within the collar; and a spring terminal held in position in reduced diameter portion of the socket base.

5 Claims, 2 Drawing Sheets

W-2 BULB SOCKET ARRANGEMENT

FIELD OF THE INVENTION

The field of the present invention is that of arrangements of seal W-2 type automotive electrical sockets commonly used for lighting fixtures.

BACKGROUND OF THE INVENTION

W-2 type bulbs are used in many automotive lighting applications. Typically, most W-2 type bulb sockets have a twist light type socket which utilizes a compression seal. Desirable characteristics of W-2 type sockets are that they have a low cost, provide high sealing capabilities, require low bulb and socket insertion efforts and fit within a small package.

SUMMARY OF THE INVENTION

The present invention provides a W-2 socket which does not require the utilization of a compression seal and which also requires a lower insertion effort, all providing superior sealing capabilities when compared to those W-2 sockets which were previously available.

DESCRIPTION OF THE PREFERRED EMBODIMENT

Figure 1:
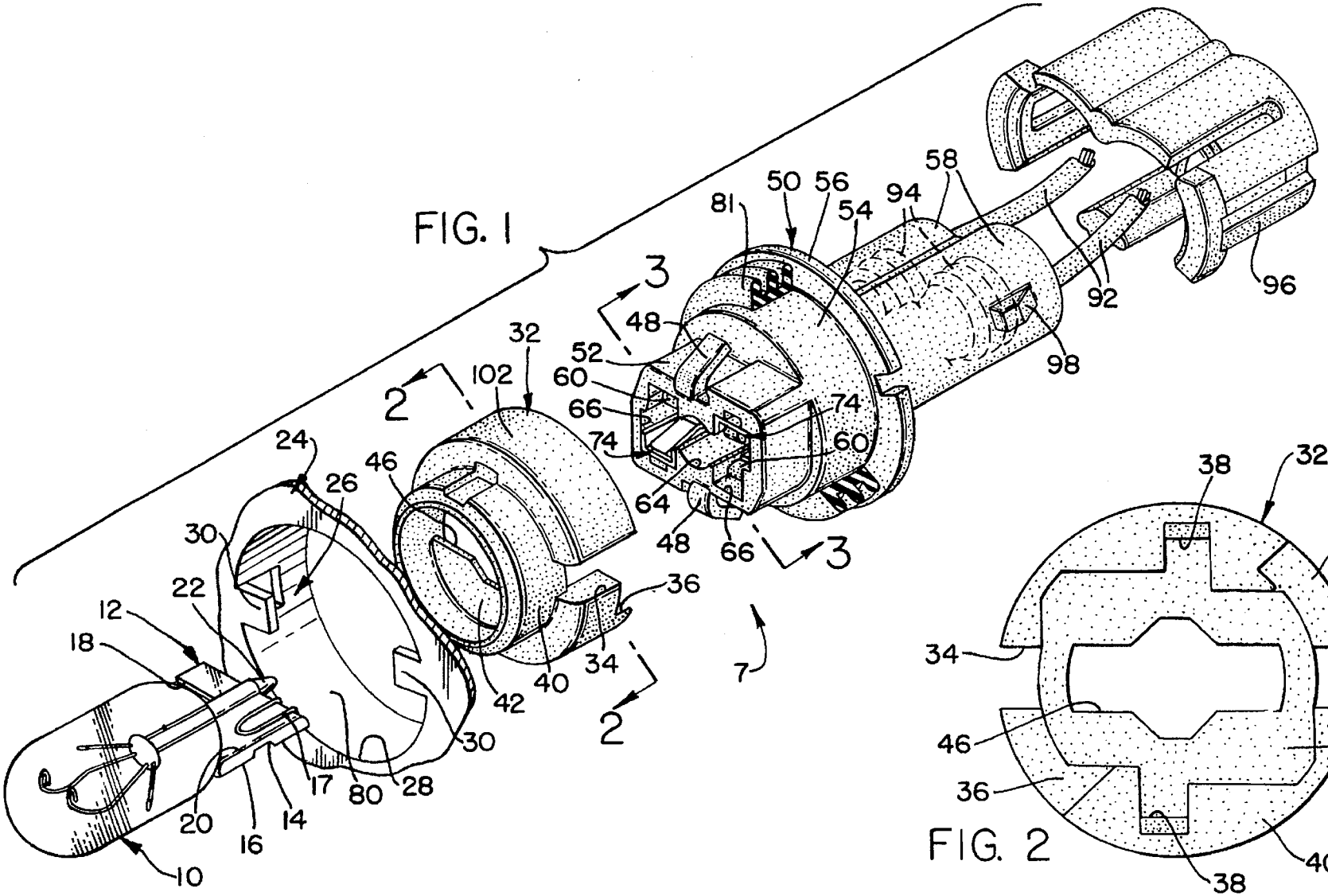
FIG. 1 is an exploded view of a preferred embodiment W-2 light socket arrangement according to the present invention.
Figure 2:
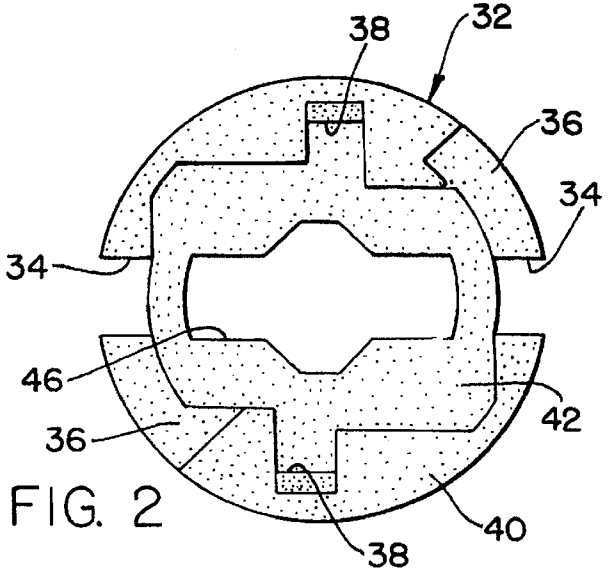
FIGS. 2 and 3 are views taken along lines 2—2 and 3—3, respectively, of FIG. 1.

Referring to FIGS. 1–5, the preferred embodiment W-2 sealed bulb socket arrangement 7 according to the present invention has a W-2 type light bulb 10 with a thumb tab end 12. The top side 20 of the tab end 12 has a groove 18 formed thereon and a terminal loop 17 formed by a terminal that passes through the tab end 12. The opposite lower side 16 of the tab end 12 also has a groove 14 and a terminal loop (not shown) that are diagonally located but identical to groove 18 and terminal loop 17 on the top side 20. As shown, the W-2 light bulb is a model number 194 light bulb produced by General Electric, although other suitable alternatives may be utilized. The light bulb 10 also has a conical tail 22.

The socket arrangement 7 includes a portion of a housing 24 having a cylindrical collar 26 with an opening or bore 28 with two inwardly projecting opposed tabs 30. Typically, the light bulb 10 will be directed toward an interior of a lens housing compartment of a side marker or license plate lamp of a vehicle, and the collar 26 opens to a portion of the vehicle which may be exposed to moisture, such as an engine compartment. Inserted through the opening 28 is a retainer 32. The retainer 32 has two longitudinal slots 34 which allow for insertion of the retainer through the opening 28 past the tabs 30. The longitudinal slots 34 are intersected by circumferential slots 36 which allow the retainer to be twisted and locked in position within the opening 28 when the socket 7 is fully assembled.

The retainer 32 has two interior ledges 38 and a head portion 40. The head portion 40 has a floor 42 for seating the light bulb 10. The retainer 32 floor 42 also has an opening 46 for passage of the tab 12 of the bulb 10.

Inserted within the retainer and connected thereto by lock arms 48 is a socket base 50. Socket base 50 has a head 52 joined to a seal mounting portion 54, which is bordered at its rearward end by a flange 56 and has connected thereto two tubular passages 58. The head 52 has the two retainer lock arms 48 rearwardly inclined therefrom. The head also has two integral bulb lock arms 60 with fingers 62 for insertion within the grooves 14 and 18 of the bulb. The socket head also has a central, generally circular bore 64 (best shown in FIG. 1) which accepts the conical tail 22 of the light bulb.

The interior of the socket base 50 has two interior passages 66 which have a reduced diameter portion 68 formed by inwardly projecting portions 70 and 72. Upon insertion within the bore 66, a spring-type terminal 74 having a spring arm 76 and a lock arm 78 will become locked in position, that is, it will not be able to be pulled out with a force less than that specified for the socket 7.

Figure 3:
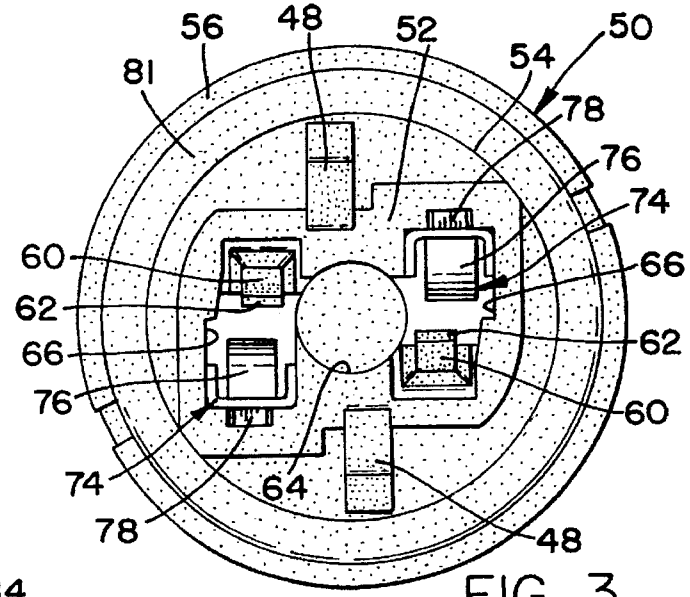
Figure 4:
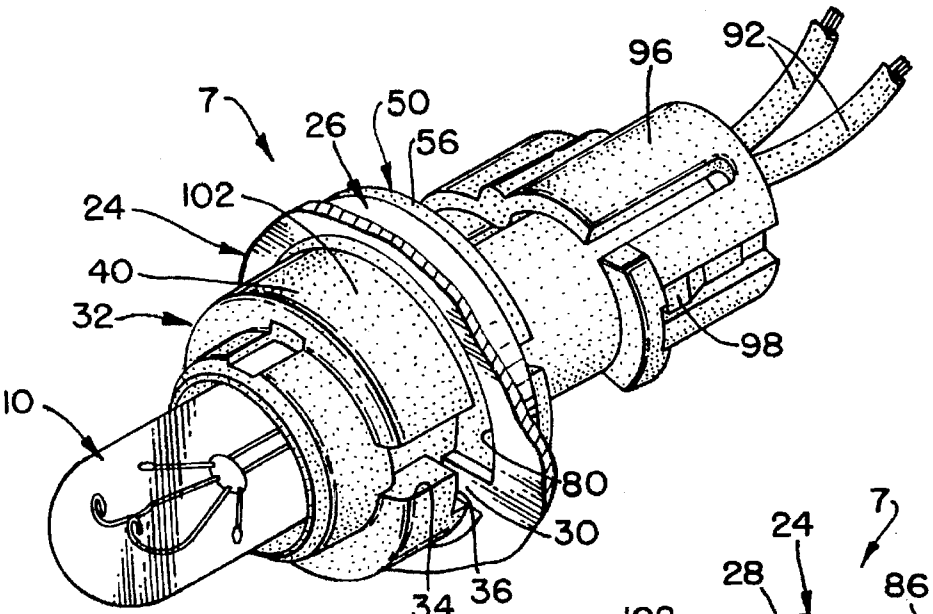
FIG. 4 is a perspective assembled view of the W-2 socket arrangement shown in FIG. 1.
Figure 5:
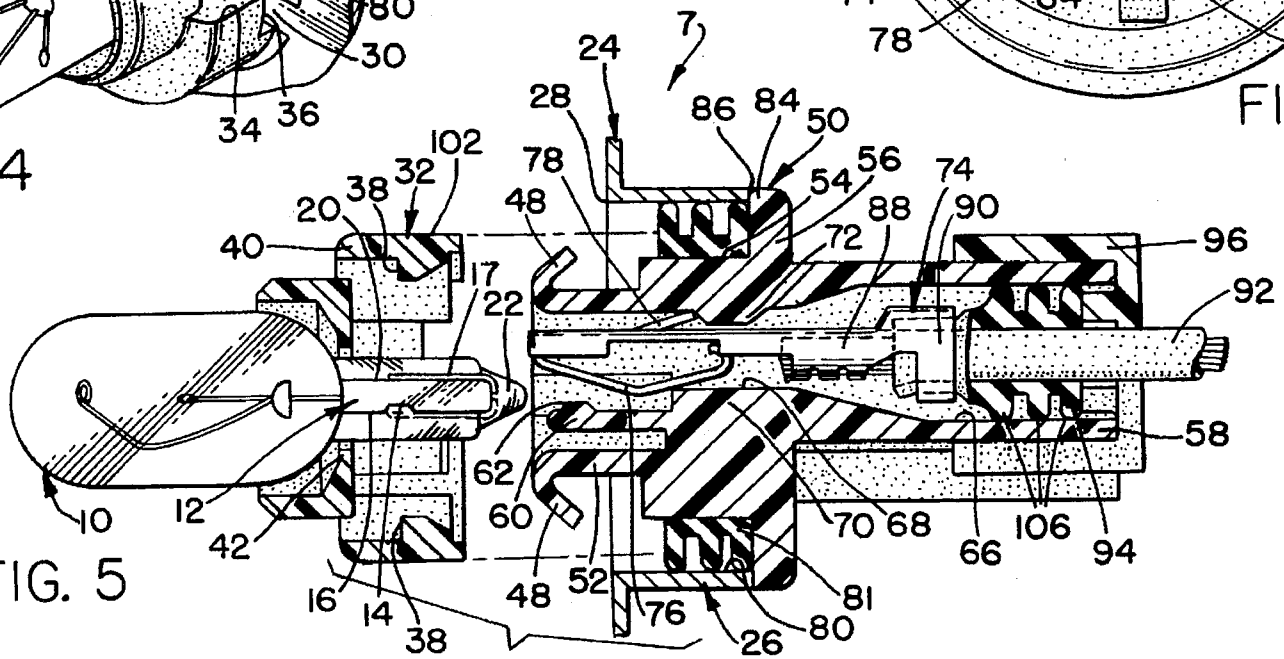
FIG. 5 is a sectional partially exploded view of the W-2 socket arrangement shown in FIG. 1.

The spring arm 76 of the terminal will make contact with the loop 17 of the filament. Terminal 74 as shown will be reversed in orientation on the opposite side of the socket body, as best shown in FIG. 3.

Since the lock arms 60 do not have to establish electrical connection, the sole function of lock arms 60 is bulb retention. Lock arms 60 can exert a normal force within the grooves 14, 18 of the bulb which may be quite low, thereby requiring lower insertion forces than that previously permissible.

The socket base 50 seal mounting portion 54 mounts a three lobe radial seal 81 which seals against an internal surface 80 of the collar 26. The seal is made from a silicon rubber type material or other suitable alternatives.

Bordering the seal mounting area 54 is a flange 84 which is spaced away from an end 86 of the collar. The tabs 30 set a maximum insertion position of the retainer base 50 with respect to the housing 24. The terminal 74 has a wire crimp 88 and an insulation crimp 90 which connect the terminal with the wire 92 and a cable seal 94. The end of the wire 92 (and terminal 74) are sealed by a series of cable seal radial lobes 106 of cable seal 94 which seal with the bore 66. Therefore, the wire 92 may have a jacket with a material impregnated with silicone or teflon and still be adequately sealed. The cable seal 94 is typically made from a silicone rubber. The cable seal 94 and terminal 74 are then held in position by a terminal position assurance cap 96 fitted on the socket base 50 by virtue of an interference fit over the lock ramps 98.

During assembly, the retainer 32 is snapped over the lock arms 48, and the subassembly is then inserted within the opening 28 and twisted to lock in position. Since the seal 81 is a radial seal, insertion forces are minimal by virtue of the seal, and the seal does not have to be compressed. The seal cannot be wiped out of position due to the protection of the flange 84 and the retainer 32, which has an outer diameter on its enlarged body portion 102 which is greater than the ID of the seal 81.

While this invention has been described in terms of a preferred embodiment thereof, it will be appreciated that other forms could readily be adapted by one skilled in the art. Accordingly, the scope of this invention is to be considered limited only by the following claims.

What is claimed is:

1. A seal lamp socket arrangement for mounting a W-2 type bulb comprising:

a housing with a collar and a base with a bore with opposed inwardly projecting tabs;

a retainer with a diameter generally aligned with the housing bore with twist lock slots allowing for insertion of the retainer through the housing opening past the opposed tabs and for connection with the housing upon rotation, the retainer having at least one internal ledge;

a socket base having a seal mounting portion to position a seal in sealing contact with the housing collar, the socket base also having at least two bores with a reduced diameter portion to entrap a spring terminal, and the socket base having two compliant tabs for capture of a W-2 type bulb and at least one ledge to connect the retainer to the socket base whereby the retainer retains a seal within the collar; and a spring terminal held in position in the reduced diameter portion of the socket base.

2. A seal lamp socket arrangement as described in claim 1 wherein said terminal is sealed within the socket base.

3. A seal lamp socket arrangement as described in claim 2 wherein the terminal is sealed by a radial lobe seal.

4. A seal lamp socket arrangement as described in claim 3 wherein there is a terminal cap to position the radial lobe seal and assure the proper position of the terminal.

5. A seal lamp socket arrangement as described in claim 1 wherein the socket base has a head forward of the seal mounting portion, the head having rearward sloping tabs to engage the internal ledge of the retainer.

* * * * *